US005810299A

United States Patent [19]

Poulos

[11] Patent Number: 5,810,299

[45] Date of Patent: Sep. 22, 1998

[54] GOLF BAG SUPPORT STAND

[76] Inventor: Jon Poulos, 230 Cambria Rd., Palm Beach Gardens, Fla. 33418

[21] Appl. No.: 834,494

[22] Filed: Apr. 14, 1997

[51] Int. Cl.[6] ..... A63B 55/00

[52] U.S. Cl. ..... 248/96; 211/195; 211/96; 280/36; 248/97

[58] Field of Search ..... 248/96, 97, 175; 211/181.1, 70.2, 195

[56] References Cited

U.S. PATENT DOCUMENTS 1,006,328 10/1911 Widenhofer ..... 211/195
1,627,459 5/1927 Ranney ..... 248/96
1,771,754 7/1930 Hauenstein ..... 248/175
2,452,929 11/1948 Holcomb ..... 280/36
5,213,221 5/1993 Raye, Sr. ..... 211/195

*Primary Examiner*—Leslie A. Braun
*Assistant Examiner*—Kimberly T. Wood
*Attorney, Agent, or Firm*—McHale & Slavin, P.A.

[57] ABSTRACT

The instant invention is a golf club bag support for use in a deep well or short wheel base vehicle. The device consists of a rack and adjustable stand member which allows the rack to be placed at various angular positions for placement beneath a golf club bag which allows for positioning of the bag at various angles so as to avoid impact with the chassis rail of a deep well trunk or the side wall of a narrow wheel based vehicle.

6 Claims, 4 Drawing Sheets

GOLF BAG SUPPORT STAND

FIELD OF THE INVENTION

This invention is related to the storage of golf clubs and, in particular, to an adjustable stand that accommodates the trunks of various deep well or short wheel based automobiles for maintaining a golf cart bag in a predetermined position.

BACKGROUND OF THE INVENTION

The game of golf is well established as an activity that can be played by a novice or professional, making it one of the most popular outdoor sporting activities in the world. By way of background, golf is a game that is played using specially designed clubs to propel a small hard ball over a field of play known as a course or links. The object of the game is to advance the ball around the course using as few strokes as possible. The clubs are of various sizes, materials and construction and used in achieving distance, height, or accurate placement of the ball. The angle of the club and the angle in which an individual strikes the ball determines the trajectory of the ball. For distances, clubs known as the drivers are used. Whereas for accuracy, such as approach shots, smaller clubs commonly referred to as irons are used.

As with any sporting activity, there exists an element of competition allowing the participants to increase their advantage through experience and higher quality equipment. The higher quality equipment is a substantial investment, even if the participant wishes to play only sporadically. As the clubs are one of the most important items used in playing of the sport, great care has been made in their manufacture so as to provide proper flex and strength.

The problem which this invention addresses is directed to various types of automobiles having a deep well trunk or narrow wheel base. A deep well trunk is characterized by a bottom wall of the trunk being placed at a level beneath the chassis rails typically found in rear wheel drive automobiles, such as the Lincoln Town Car, but may also be found in front wheel drive automobiles, such as the Audi. In an effort to increase trunk space, the vehicle manufacturer has provided a deep well which results in a problem for the owner of the golf clubs. For example, placement of a set of golf clubs in a present day Lincoln Town Car will result in at least a portion of the clubs resting against the chassis ledge forming the deep well. Should the clubs include graphite shafts, the placement of the shafts across the ledge will result in almost immediate damage to the shaft. The result of which can be costly for replacement. The damage may be latent and result in poor play.

Sport utility vehicles having a small wheel base, such as the Ford Explorer, are also not able to take a set of clubs across the width of the vehicle. The result is possible damage to the shafts should the bags be placed in such a position putting a stress directly on the club shafts.

Thus, what is needed in the art is a device capable of maintaining the clubs to prevent damage when placed in a deep well or short wheel base vehicle, said device being of minimal weight and easily stored when the device is not in use.

SUMMARY OF THE INVENTION

The instant invention is a golf bag support stand for use in deep well or short wheel base vehicles capable of placing golf bags at an incline angle so as to avoid club shaft damage. The device includes a two-step angular support stand having a rack with adjustments made possible by sliding a pivotal stand forward into predetermined positions. In this manner, a golf bag is angled so as to maintain the golf club shafts at a position above the chassis rails or the side walls of the narrow wheel base vehicle.

The device includes a first section forming a rack with curved cross members placed therebetween so as to accommodate the curvature of a golf bag and prevent the golf bag from moving during quick vehicle starting or stopping. An adjustment stand is secured to the front of the rack and folds flat for storage purposes, yet rotates into a position depending from the end of the rack so as to place one end of the rack in a raised position. The stand is formed from a single piece of rigid steel wire and includes an angular design shape that allows for placement of the stand in two predetermined positions. The positions depicted are common for present day deep well vehicles thereby allowing the stand to accommodate most such vehicles for the purpose of golf club shaft protection. While the preferred construction is steel wire, it would be obvious to one of ordinary skill in the art to note that other various types of construction, such as plastic, are possible without defeating the intent of our invention.

Thus, an objective of the instant invention is to disclose a golf bag stand for use in deep well and small wheel based vehicles for the purpose of positioning a golf club bag at an inclined angle for protection of the club shafts stored with the golf bag.

Another objective of the instant invention is to disclose an inexpensive golf club support stand that can be folded into a storage position when not in use.

Yet another objective of the instant invention is to disclose a device that allows for the orderly storage of golf bags within any type of vehicle with the benefit of positioning the clubs off the supporting surface so as to provide longevity to the clubs.

Other objects and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objectives and features thereof.

DETAILED DESCRIPTION OF THE PREFERRED EMBODIMENT

Figure 1:
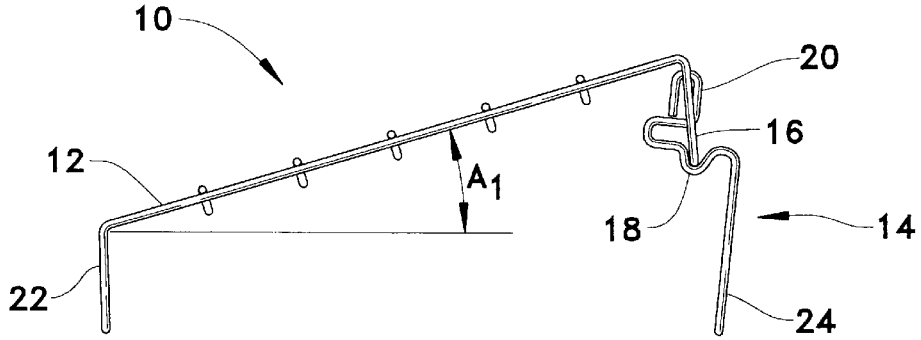
FIG. 1 is a side view of the device in a raised position.
Figure 2:
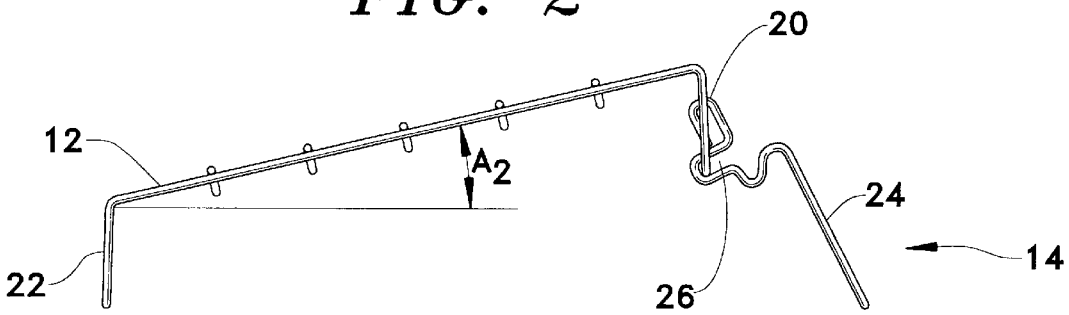
FIG. 2 is a side view of the device in a lower raised position.

Now referring to FIGS. 1 and 2, set forth is a side view of the device 10 consisting of a rack 12 and stand 14. The device is shown in a raised position with the legs 16 along one end of the rack positioned in a raised support section 18 of the stand. The stand 14 is pivotal along pivot rod 20 so as to allow for rotation which will be further described later in this description. The rack 12 includes legs 22 located at the opposite end to allow the rack to pivot when used in conjunction with the stand 14 so as to provide an angle $A_1$. a function of the length of stand leg 24. The rack 12 and stand 14 are each preferably constructed of steel rods. Alternatively the stand may be constructed of plastic or any other rigid material.

FIG. 2 shows the stand 14 placed in a lower support position 26 wherein the angle $A_2$ is decreased with stand leg 24 extending outward for use in those instances where a raised angle need only be of minimal height. For example, vehicles having a narrow wheel base, such as sport utility vehicles, lack sufficient space for a set of golf clubs to be situated across the width of the vehicle. In this example, the configuration set forth in FIG. 2 will allow a minimal rise of the golf club bag allowing the golf clubs to be placed across the width of the vehicle with minimal touching of the side wall.

Figure 3:
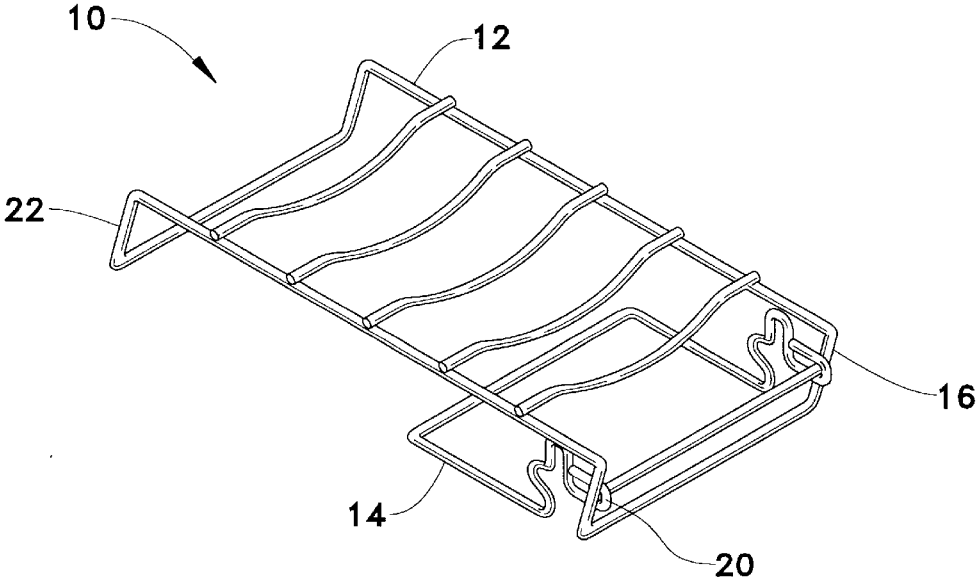
FIG. 3 is a perspective view of the device in a storage position.
Figure 4:
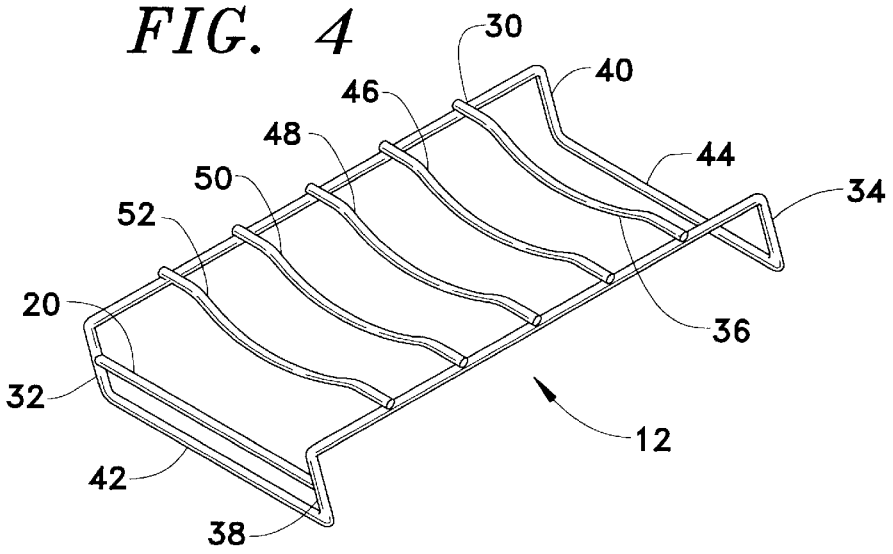
FIG. 4 is a perspective view of the rack.

FIG. 3 illustrates the device 10 in a closed position with the rack 12 having legs 16 and 22 set on a flat surface with stand 14 folded beneath the rack by pivoting along pivot rod 20. The rack 12, as more fully illustrated in FIG. 4, consists of a continuous side wall formed from an upper side rail 30 leading to end leg 32 and end leg 34 which are coupled to the opposing side rail 36 having legs 38 and 40 each coupled to the opposing side leg by cross legs 42 and 44, respectively. The pivot rod is welded to the side rail legs 38 and 40 and is used in conjunction with the side rails 30 and 36. The rails are maintained in a separated position by cross supports 46, 48, 50, and 52 which each consists of a similar sized diameter wire having each end forming a hook around the side rail providing both a spatial distancing of the side rails. It is noted that additional cross members may be used without defeating the intent of the invention.

Figure 5:
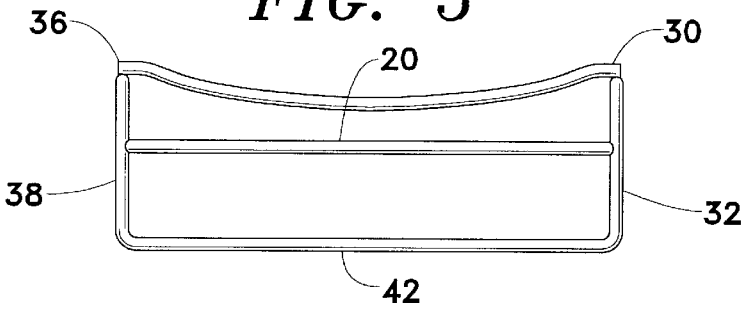
FIG. 5 is an end view of the rack.

FIG. 5 illustrates an end view with legs 32 and 38 coupled together by lower leg 42 and pivot rod 20. Cross support 52 is depicted having a curvature formed by placement of the cross support in such a position that allows the middle section of the cross support to be placed at a distance beneath each of the side rails. The curvature maintains a golf bag in position as it accommodates the rounded shape of a golf club bag thereby preventing the golf club bag from sliding off the device when a vehicle is started or stopped quickly.

Figure 6:
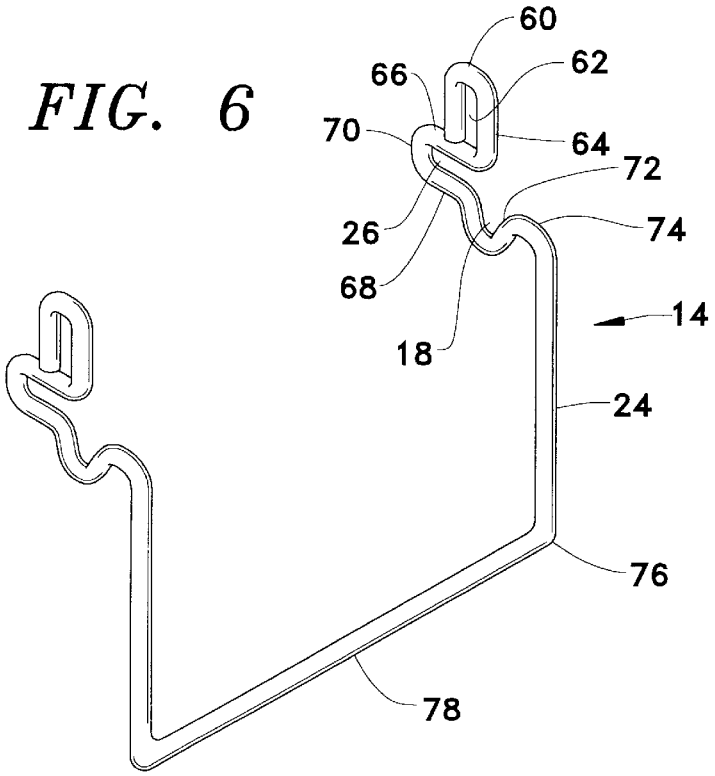
FIG. 6 is a perspective view of the stand.

FIG. 6 sets forth the stand 14 characterized by a first pivot rod hook end 60 placed around the pivot rod member of the rack to form an elongated slot 62, the slot 62 allows movement of the stand in an upward or downward position for positioning the rack leg leading to the aforementioned angular positioning. The pivot rod hook 60 includes extension leg 64 leading downward from the pivot rod hook to lower support portion 26 which forms a rectangular shape with inward depending leg 66 coupled to outward depending leg 68 by end leg 70. The lower support section operates in conjunction with the elongated slot requiring the pivot rod to be located along a lower portion of the slot, closest to lower support section 26, which allows the leg of the rack to be placed outward of the depending leg 68 and end leg 70 placing the rack at an angular position.

Raised support section 18 is formed by a semi-circular or U-shaped member 72 which requires the pivot rod to be placed along the upper portion of slot 62 for positioning of leg 42 allowing for a raised angle such as that depicted in FIG. 1. It will be obvious to one of ordinary skill in the art that multiple levels can be obtained. The two positions are believed to be the most preferable configurations, striking a balance between a low cost assembly and capturing the two most prevalent angular positions for modern vehicles. The angular height is formed by the length of stand leg 24 leading from end 74 to opposite end 76. This portion of the stand is coupled to a second portion of the stand forming a mirror image thereof for coupling to the pivot rod hook by cross leg 78. For drawing simplicity, the second portion of the stand, as shown in FIG. 6, will not be numbered as it forms the mirror image of the first portion.

Figure 7:
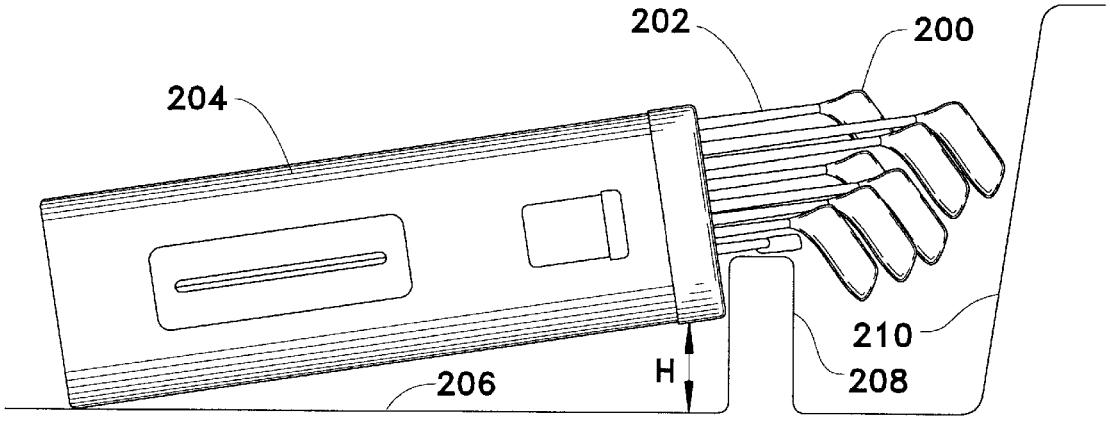
FIG. 7 is a pictorial view of golf clubs placed within a deep well trunk of a vehicle.

Now referring to FIG. 7, shown is a typical set of golf clubs 200 having shafts 202 extending from golf club bag 204. One end of the golf club bag 204 rests on the floor 206 of a deep well trunk defined by a chassis rail 208. The chassis rail extends through the trunk and is typically used to support a bumper at the rear of the vehicle. The golf club bag 204 remains a height (H) from the floor 206 of the trunk above an upper edge of the chassis rail 208 which causes the clubs to rest against the chassis rail. By way of illustration, it is noted how the chassis rail impacts against the shafts 202. This impact can lead to damage of the clubs should the vehicle hit any rough terrain during movement.

Figure 8:
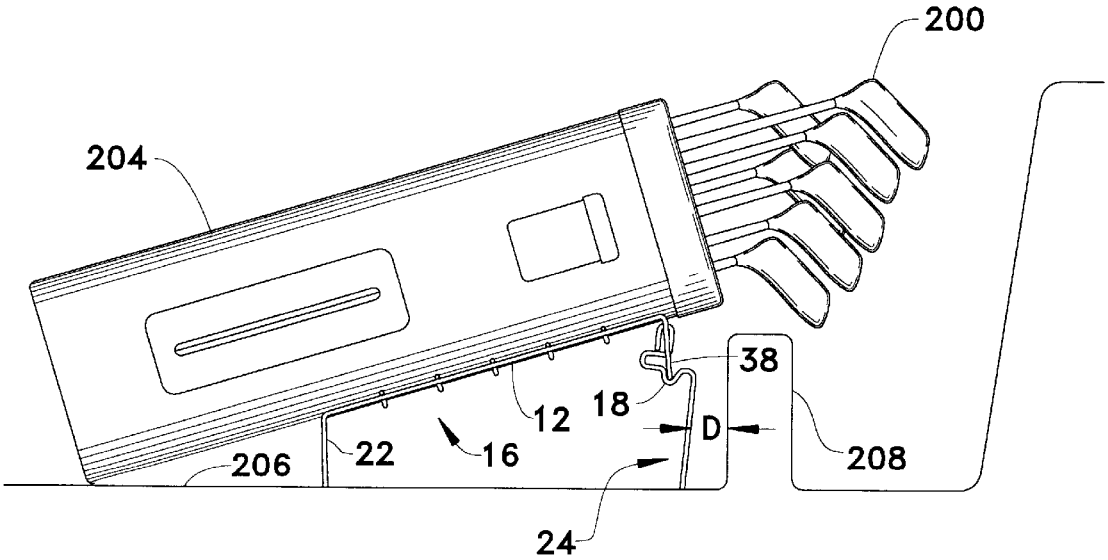
FIG. 8 is a pictorial view of golf clubs placed within a deep well or small base trunk of a vehicle having the device positioned so as to maintain the clubs from contacting the chassis rail which forms a part of the trunk.

Now referring to FIG. 8, the device 10 is shown placed along the floor 206 of the trunk with golf club bag 204 placed thereon. The rack 12 is placed in an angular position wherein leg 40 abuts the floor with leg 38 placed along raised support 18 which positions the stand in an upright configuration with stand leg 24 nearly perpendicular to the floor. In this illustration, golf clubs 200 are raised a distance above the chassis rail 208 thereby avoiding damage to the clubs 200. As previously mentioned, the device 10 can be slid a distance D from the chassis rail 208 which will result in the upward or downward movement of the golf club bag in relation to the chassis rail should a smaller or deeper trunk well be encountered.

Figure 9:
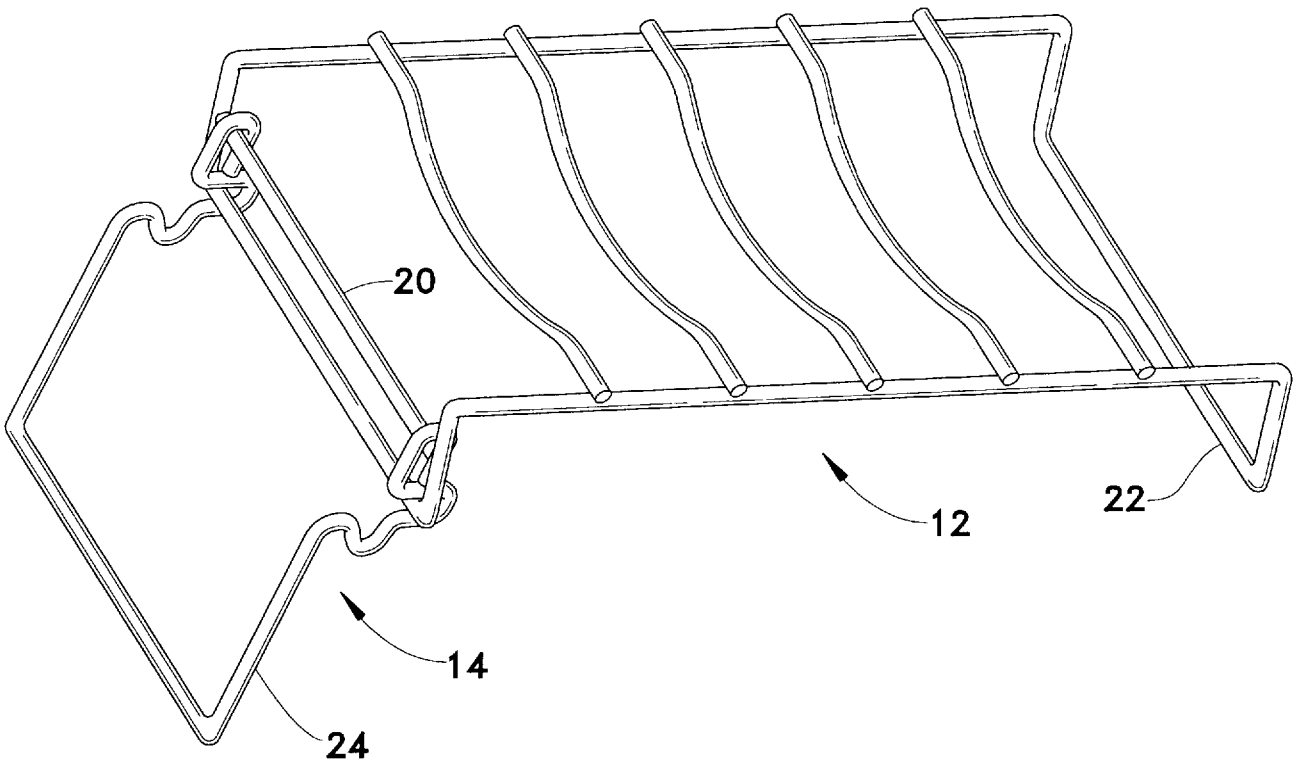
FIG. 9 is a perspective view of the invention.

FIG. 9 is a perspective view of the invention which illustrates the stand 14 placed in a support position with stand leg 24 extending outward for use in instances where a raised angle need only be of minimal height. The rack 12 is shown angled in view of pivot rod 20. Legs 22 located at the opposite end allow the rack to pivot when used in conjunction with the stand 14. The dimension of the rack is approximately 10 inches wide by 18 inches long and is raised approximately 3 inches from a support floor by the legs. When the stand is employed, the first recess allows the end of the rack to be placed approximately 7 inches from the support floor, the second recess allows the end of the rack to be placed approximately 11 inches from the support floor.

It is to be understood that while a certain form of the invention is illustrated, it is not to be limited to the specific form or arrangement of parts herein described and shown. It will be apparent to those skilled in the art that various changes may be made without departing from the scope of the invention and the invention is not to be considered limited to what is shown in the drawings and described in the specification.

I claim:

1. A golf bag support comprising:

a rack having as a first and second side rail with a plurality of interconnecting supports forming a cradle therebetween, said side rails further coupled together by a front and rear leg depending downward from each said side rail;

and a stand slidably secured to one end of said rack, said stand formed from a continuous rod structure, said rod structure having a first curvature forming an upper ledge and a second curvature forming a lower ledge, said stand having a first end secured to a first side of said end of said rack with said upper ledge formed from a U-shaped frontward facing curvature and said lower ledge formed from a U-shaped upward facing curvature, a second end of the stand secured to a second side of said end of said rack with said upper ledge formed from a U-shaped frontward facing curvature and said lower ledge formed from a U-shaped upward facing curvature, said ledges operatively associated with said legs of said rack for securing said rack at various angles;

wherein each said ledge allows said rack to be positioned at a first or second angle whereby said rack is available for the positioning of golf clubs at said first or second angle.

2. The golf bag support according to claim 1 wherein said rack is constructed from steel rod.

3. The golf bag support according to claim 1 wherein said first and second side rails and said front and rear legs are formed from a continuous steel rod.

4. The golf bag support according to claim 1 wherein said interconnecting supports include a semi-circular curvature for positioning a golf bag between said side rails.

5. A golf bag support comprising:

a rack constructed from a steel rod having as a first and second side rail with a plurality of interconnecting supports forming a cradle therebetween, said side rails further coupled together by a front and rear leg depending downward from each said side rail;

and a stand constructed from a steel rod slidably secured to one end of said rack, said stand formed from a continuous rod structure, said rod structure having a first curvature forming an upper ledge and a second curvature forming a lower ledge, said stand having a first end secured to a first side of said end of said rack with said upper ledge formed from a U-shaped frontward facing curvature and said lower ledge formed from a U-shaped upward facing curvature, a second end of the stand secured to a second side of said end of said rack with said upper ledge formed from a U-shaped frontward facing curvature and said lower ledge formed from a U-shaped upward facing curvature;

wherein each said ledge allows said rack to be positioned at a first or second angle whereby said rack is available for the positioning of golf clubs at said first or second angle.

6. The golf bag support according to claim 5 wherein said interconnecting supports include a semi-circular curvature for positioning a golf bag between said side rails.

* * * * *